US010988355B2

(12) United States Patent
Tokutome et al.

(10) Patent No.: US 10,988,355 B2
(45) Date of Patent: Apr. 27, 2021

(54) MOBILE CRANE

(71) Applicant: Maeda Seisakusho Co., Ltd., Nagano (JP)

(72) Inventors: Shinya Tokutome, Nagano (JP); Tatsufumi Tomura, Nagano (JP); Ryosuke Nakamura, Nagano (JP); Eiji Ichimura, Nagano (JP); Mitsuaki Wada, Nagano (JP)

(73) Assignee: MAEDA SEISAKUSHO CO., LTD., Nagano (JP)

( * ) Notice: Subject to any disclaimer, the term of this patent is extended or adjusted under 35 U.S.C. 154(b) by 156 days.

(21) Appl. No.: 16/304,872

(22) PCT Filed: Dec. 16, 2016

(86) PCT No.: PCT/JP2016/087615
§ 371 (c)(1),
(2) Date: Nov. 27, 2018

(87) PCT Pub. No.: WO2017/216985
PCT Pub. Date: Dec. 21, 2017

(65) Prior Publication Data

US 2020/0283273 A1 Sep. 10, 2020

(30) Foreign Application Priority Data

Jun. 17, 2016 (WO) ..... PCT/JP2016/068043

(51) Int. Cl.
*B66C 23/94* (2006.01)
*B66C 13/40* (2006.01)
(Continued)

(52) U.S. Cl.
CPC ..... *B66C 23/94* (2013.01); *B66C 9/00* (2013.01); *B66C 13/16* (2013.01); *B66C 13/40* (2013.01);
(Continued)

(58) Field of Classification Search
CPC ..... B66C 13/16; B66C 13/18; B66C 13/20; B66C 13/40; B66C 13/44; B66C 13/54; B66C 15/00; B66C 23/94; B66C 23/78
See application file for complete search history.

(56) References Cited

U.S. PATENT DOCUMENTS 5,823,369 A * 10/1998 Kuromoto ..... B25J 9/1638 212/273
10,077,174 B1 * 9/2018 Phillips ..... B66C 23/44
(Continued)

FOREIGN PATENT DOCUMENTS

JP 10230824 A 9/1998
JP 10250989 A 9/1998
(Continued)

OTHER PUBLICATIONS

Machine Translation of JPH-10250989 (Year: 1998).*
(Continued)

*Primary Examiner* — Michael R Mansen
*Assistant Examiner* — Juan J Campos, Jr.
(74) *Attorney, Agent, or Firm* — Buchanan Ingersoll & Rooney PC

(57) ABSTRACT

A crawler crane includes: a seating switch that detects whether an operator is in a driver seat; a turn angle potentiometer that detects the turn position of a boom; and a controller. The controller is provided with a boom turn restriction control unit for performing a boom turn-restricting control whereby the boom is not allowed to turn within a predetermined angular range above the driver seat on the basis of the output from the turn angle potentiometer. The boom turn restriction control unit includes a restriction-canceling unit that cancels the boom turn-restricting control performed by a turn-restricting unit if a preset restriction-canceling condition is met. The boom turn restriction control unit cancels the boom turn-restricting control if the seating
(Continued)

switch does not detect an operator. Ease of operation and work can thus be improved in a remote operation mode and the like.

8 Claims, 7 Drawing Sheets

(51) Int. Cl.

| | |
|---|---|
| ***B66C 15/00*** | (2006.01) |
| ***B66C 23/78*** | (2006.01) |
| ***B66C 9/00*** | (2006.01) |
| ***B66C 13/16*** | (2006.01) |
| ***B66C 13/54*** | (2006.01) |
| ***B66C 23/42*** | (2006.01) |
| ***B66C 23/80*** | (2006.01) |

(52) U.S. Cl.
CPC ..... *B66C 13/54* (2013.01); *B66C 15/00* (2013.01); *B66C 23/42* (2013.01); *B66C 23/78* (2013.01); *B66C 23/80* (2013.01); *B66C 2700/0371* (2013.01)

(56) References Cited

U.S. PATENT DOCUMENTS

2002/0053442 A1* 5/2002 Halme ..... B62D 33/0633 172/2
2004/0095285 A1* 5/2004 Aquino ..... B66C 13/40 343/713
2007/0144995 A1* 6/2007 Emminger ..... B66C 23/94 212/278
2007/0219662 A1* 9/2007 Sawodny ..... B66C 23/62 700/213
2011/0062104 A1* 3/2011 Schneider ..... B66C 15/065 212/276
2013/0033493 A1* 2/2013 Kiyota ..... G06T 3/0062 345/420
2013/0033494 A1* 2/2013 Kiyota ..... G06T 15/205 345/420

FOREIGN PATENT DOCUMENTS

JP 2000262142 A 9/2000
JP 2014210625 A 11/2014

OTHER PUBLICATIONS

Machine Translation of JP-2000/262142 (Year: 2000).*
Machine Translation of JP-2014/210625 (Year: 2014).*
International Search Report (PCT/ISA/210) dated Mar. 7, 2017, by the Japanese Patent Office as the International Searching Authority for International Application No. PCT/JP2016/087615.
Written Opinion (PCT/ISA/237) dated Mar. 7, 2017, by the Japanese Patent Office as the International Searching Authority for International Application No. PCT/JP2016/087615.

* cited by examiner

3: DRIVER SHEAT
30: CONTROLLER
31: OPERATION PANEL
33: REMOTE OPERATION UNIT
40: BOOM TURN RESTRICTION CONTROL UNIT
40A: TURN-RESTRICTING UNIT
40B: RESTRICTION-CANCELING UNIT
41: TURN ANGLE DETECTION POTENTIOMETER
42: SEATING SWITCH
50: OUTRIGGER EXTRACTION CONTROL UNIT
55: VEHICLE BODY INCLINATION DETECTOR
56, 57, 58, 59: OR CYLINDER

MOBILE CRANE

TECHNICAL FIELD

The present invention relates to a crawler crane, a track crane, or another mobile crane, and particularly relates to a safety mechanism of a mobile crane.

BACKGROUND ART

One known example of a mobile crane is a small mobile crane in which a boom of a crane apparatus turns above a driver seat, the seat being in a fixed position. In a small mobile crane provided with a driver seat that has no roof, a turn restriction mechanism is provided as a safety mechanism so that the boom does not turn above the head of an operator sitting in the driver seat and performing operations.

The turn restriction mechanism restricts the boom to be unable to turn in a predetermined angular range directly above the driver seat. Because the boom is unable to turn directly above the driver seat, the turning boom is prevented from colliding with the operator sitting in the driver seat, and objects do not fall onto the operator from the boom. Patent Document 1 proposes a crane vehicle provided with an action-restricting apparatus for a crane boom.

A mobile crane could also be provided with outriggers in order to set up the mobile crane stably in the ground at a work site. When outriggers are extracted at a site such as one with uneven ground, some outriggers might remain raised off the ground. With the outriggers extracted, the mobile crane could have a tilted orientation, as a whole.

A mobile crane is provided with, as safety mechanisms, a mechanism that detects all of the outriggers being not raised up but in contact with the ground when the outriggers are extracted, and a mechanism that controls the crane vehicle body so as to be supported in a horizontal orientation by the outriggers. Patent Document 2 proposes an outrigger automatic extraction apparatus provided with a mechanism that prevents the outriggers from rising when extracted and controls the crane vehicle body so as to be in a horizontal orientation.

PRIOR ART DOCUMENTS

Patent Documents

Patent Document 1: JP-A 10-250989
Patent Document 2: JP-A 10-230824

SUMMARY OF THE INVENTION

Problems to be Solved by the Invention

There are cases in which a mobile crane is operated in a remote operation mode that uses a remote operation unit. In the remote operation mode, there are no problems if the boom turns through the space above the driver seat because an operator is not sitting in the driver seat. In crane work performed through remote operation, enabling the boom to rotate 360 degrees makes boom operation easier and also makes work easier. Furthermore, there are cases in which, due to circumstances at the work site, unloading work or the like must be performed with the boom having been turned to be directly above the driver seat.

As an example of a prior-art safety mechanism, a boom turn-restricting mechanism automatically activates and constantly restricts the turning range of the boom. When an operator is not sitting in the driver seat, such as is the case during remote operation mode or automatic operation mode, the turn-restricting mechanism is sometimes an obstacle to efficient action or work. There are also cases of inconvenience suffered because unloading work, etc., cannot be performed with the boom having been turned to be directly above the driver seat.

In unloading work using a mobile crane, etc., the crane vehicle body supported by the outriggers sometimes sinks due to the exerted load. When the gap between the lower traveling body of the crane vehicle body and the ground surface is small, accidents can occur, such as the bottom surface of the lower traveling body pushing against the ground surface and being damaged. Conversely, when the lower traveling body supported by the outriggers is raised far up from the ground surface (when the gap is large), the mobile crane as a whole sometimes becomes unstable in unloading work or the like. For example, in the case of X-type outriggers, when the extraction amount is increased, the angle of inclination relative to the ground surface increases, and the mobile crane readily becomes unstable.

In the prior art, the only safety mechanisms for outrigger extraction in mobile cranes have been mechanisms preventing outrigger rising and mechanisms for preventing vehicle body tilting. No focus has been given to undesirable effects caused by too large or too small of a gap being present between the lower traveling body and the ground surface when the outriggers are extracted, or to countermeasures for such effects.

With the foregoing in view, an object of the present invention is to provide a mobile crane provided with a safety mechanism that performs boom turn control without hindering operability or workability.

Another object of the present invention is to provide a mobile crane provided with a safety mechanism that can bring about an appropriate outrigger-extracted state.

Means of Solving the Above Problems

A mobile crane according to the present invention is characterized by including:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancellation condition is fulfilled.

In the mobile crane of the present invention, the boom turn restriction control is canceled upon fulfillment of a restriction cancellation condition, such as there being no operator in the driver seat. For example, in a case of the mobile crane having a remote operation unit that remotely operates the lower traveling body and the crane apparatus, the restriction-canceling unit cancels the boom turn restriction control when there is no operator in the driver seat or when the operation mode is a remote operation mode performed by the remote operation unit. Additionally, the boom turn restriction control is canceled when there is no operator in the driver seat and remote operation mode is in effect.

In the mobile crane of the present invention, boom turn restriction is performed only when necessary. In the case of remote operation or the like, the boom can be rotated substantially 360 degrees without being restricted. The operability and workability of the mobile crane can be improved while ensuring safety at necessary times.

In this aspect of the present invention, when an operator detection unit that detects whether an operator is in the driver seat is provided, the restriction-canceling unit preferably cancels the boom turn restriction control when an operator is not detected by the operator detection unit.

The operator detection unit can be a sitting switch, e.g., a contact-type mechanical switch, a pressure detector, or the like, that detects that an operator is sitting in the seat surface of the driver seat. A non-contact motion sensor, e.g., an optical motion sensor, which is placed in the driver seat or in proximity to the driver seat, can be used. Additionally, an image acquisition and analysis means, which acquires an image of the driver seat through a camera, processes the acquired image, and assesses the presence or absence of an operator, can also be used.

A manual operation lever can be used instead of an operator detection unit. In this case, the operation lever being in the restriction-canceling position is assessed by the restriction-canceling unit to mean that the boom turn restriction control is unnecessary, such as when there is no operator in the driver seat, and the restriction-canceling unit cancels the boom turn restriction control.

In this mobile crane, there are cases in which an operation panel is placed in front of the driver seat, and consoles (laterally-positioned operation parts) are placed on both sides of the driver seat. In such cases, the operation lever can be attached to a console placed to one side of the driver seat.

In cases such as those of a small mobile crane, the space surrounding the driver seat is small. A joystick or another operation member placed on a console on the side of the driver seat is a hindrance to an operator getting on and off the driver seat. The console is, then, configured to be movable from an operating position in which the operating member can be operated, to a retracted position at which there is no hindrance to getting on and off the driver seat.

In this case, a lock mechanism is provided to lock the console in the operating position, and the lock provided by the lock mechanism can be released in coordination with the operation of a safety lever attached to the console. A detector is also provided to detect whether or not the console is locked in the operating position. The restriction-canceling unit preferably cancels boom turn restriction control when the console is detected by the detector as not having been locked.

When sitting in the driver seat and performing work, the operator operates the safety lever, returns the console to the operating position, and locks the console in the operating position through the lock mechanism. A state in which boom turn restriction control is performed is thereby brought about. When getting off the driver seat, the operator operates the safety lever, unlocks the console, and moves the console to the retracted position. A state in which turn restriction control is canceled is thereby brought about.

Next, the mobile crane of the present invention is characterized by including a plurality of outriggers attached to the lower traveling body, a controller being provided with an outrigger extraction function that controls the amount of extraction of each of the outriggers so that the gap between the bottom surface of the lower traveling body and the ground surface where the lower traveling body is positioned reaches a preset defined size.

For example, when the mobile crane includes a grounding detector that detects the grounded state of each of the outriggers, and a vehicle body tilt detector that detects the tilted state of the lower traveling body, the controller is provided with: a grounding function that causes extending actions for each of the outriggers to be performed until each of the grounding detectors detects a grounded state; a vehicle body raising function that causes the gap to reach a defined size by extending each of the outriggers simultaneously at a fixed speed for a fixed amount of time; and a horizontal aligning function that, on the basis of the output of the vehicle body tilt detector, individually extends each of the outriggers so that the lower traveling body comes to be in a horizontal orientation.

When the present invention is applied to a crawler crane, the gap is the distance between the ground surface and the lower surface of the crawler belt of the lower traveling body.

In the mobile crane of the present invention, during the outrigger-extracting action, control is performed to bring the gap between the lower traveling body and the ground surface to a defined size. Due to this control, during unloading work or the like, collisions between the bottom surface of the lower traveling body and the ground surface can be avoided, and instability in the mobile crane supported by the outriggers can be avoided.

MODE FOR CARRYING OUT THE INVENTION

An embodiment of a mobile crane to which the present invention is applied is described below with reference to the drawings. The embodiment described below is one example in which the present invention is applied to a crawler crane. The present invention can be similarly applied to a track crane, a wheel crane, and other mobile cranes.

(Overall Configuration)

Figure 1A:
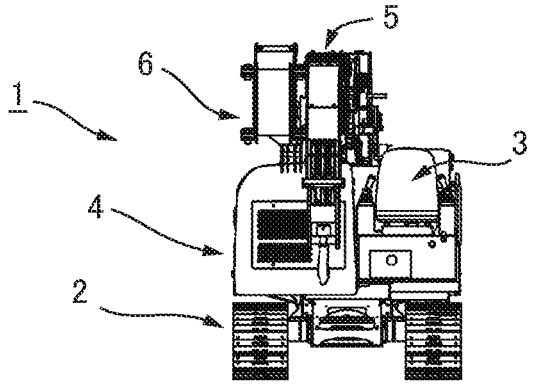
FIG. 1A is a front view showing a crawler crane according to an embodiment of the present invention.
Figure 1B:
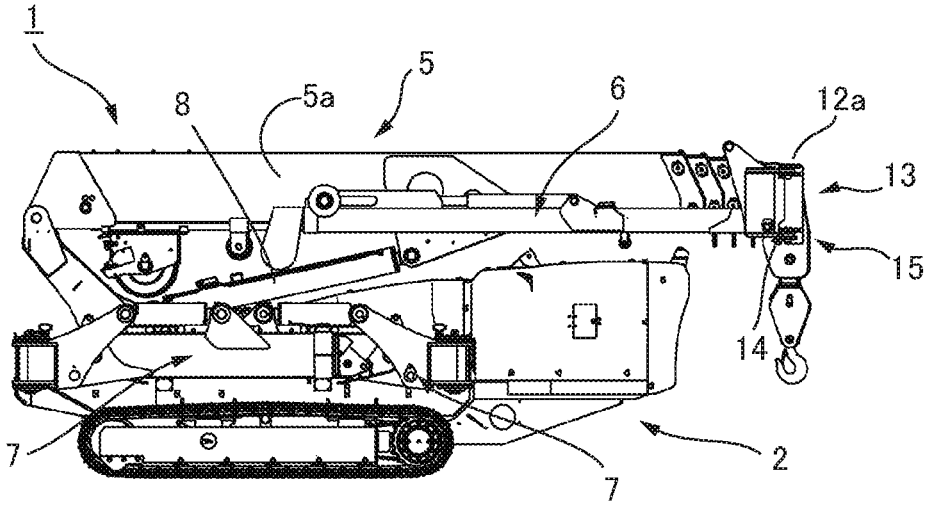
FIG. 1B is a side view of the crawler crane of FIG. 1A.
Figure 1C:
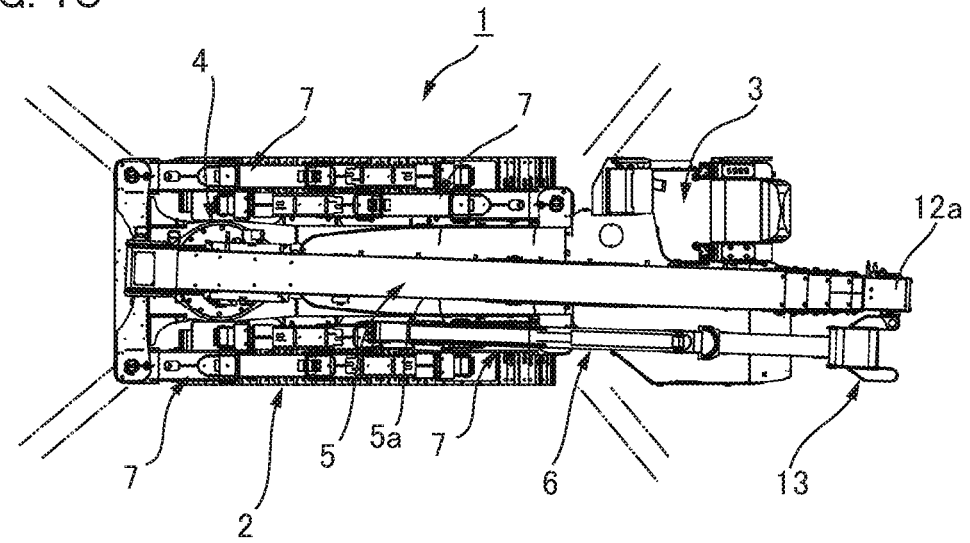
FIG. 1C is a plan view of the crawler crane of FIG. 1A.
Figure 2:
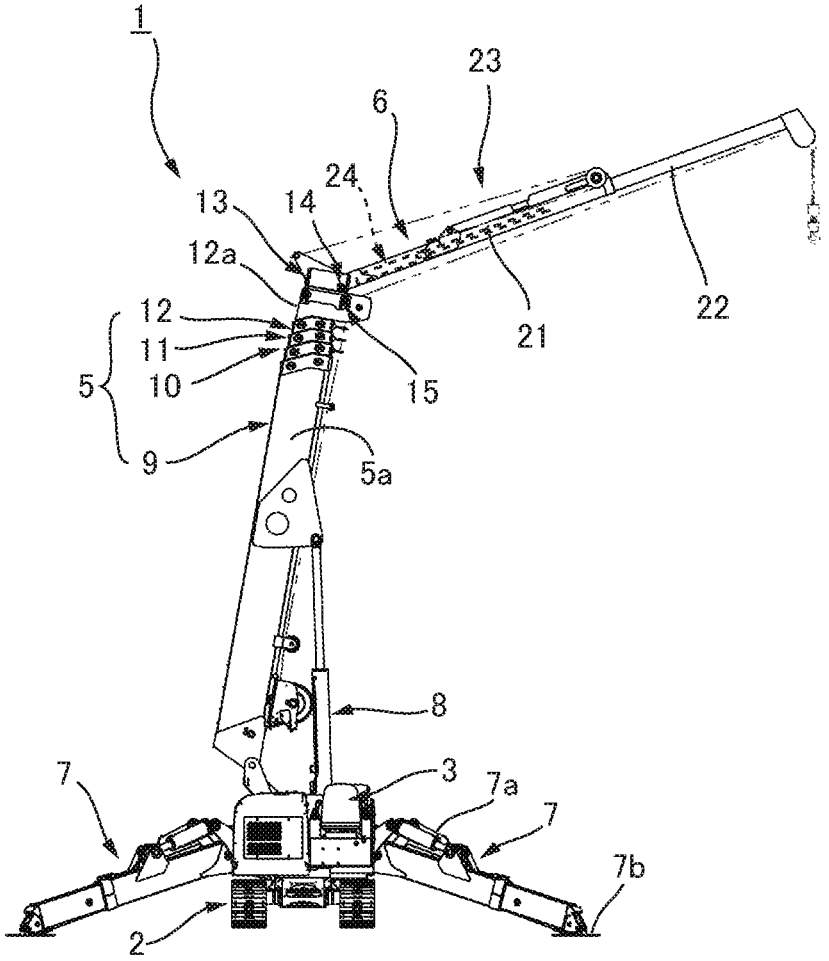
FIG. 2 is a front view showing an example of a working state of the crawler crane.

FIG. 1A is a front view showing a crawler crane according to the present embodiment, FIG. 1B is a side view of the same, and FIG. 1C is a plan view of the same. FIG. 2 is a front view showing an example of a working state using a fly jib.

A crawler crane 1 is provided with a crawler-type lower traveling body 2, a driver seat 3 placed on a fixed position that is the left side of the frontal section of the lower traveling body 2, an upper turning body 4 installed in the center of the rear section of the lower traveling body 2, and a crane apparatus installed on the upper turning body 4. The crane apparatus is constituted by a multi-stage boom 5, a fly jib 6 stored on a side surface of the boom 5 and other parts.

Outriggers 7 are attached to the four corners of the lower traveling body 2. The four outriggers 7 are capable of turning about vertical axis lines centered about the inner ends of the outriggers, as shown by the imaginary lines in FIG. 1C. With any one outrigger 7 in an outward extracting state, a state can be brought about in which a grounding plate 7*b* at the tip end is grounded by a hydraulic cylinder 7*a* as shown in FIG. 2. In this state, when the outrigger is extended in the length direction, a state can be brought about in which the crawler of the lower traveling body 2 rises upward. The crawler crane 1 can be installed so as to be stable in a predetermined work position by the four outriggers.

The upper turning body 4 is capable of turning about a vertical axis, and a boom raising/lowering cylinder 8 bridges between the upper turning body 4 and a first-stage stationary boom 9 of the boom 5. A plurality of movable booms, e.g., three movable booms 10, 11, 12, are stored in the stationary boom 9, and these movable booms can be extended and retracted by an internally provided boom extending/retracting cylinder, boom extending/retracting wire rope, or other mechanism.

The fly jib 6 is stored so as to extend along the side surface of the boom 5, as shown in FIG. 1. The rear end part of the fly jib 6 is coupled to a coupling flange 13 so as to be capable of vertically rising and falling, the fulcrum for which is a horizontal coupling pin 14 attached to the coupling flange 13 (jib-coupling member). The coupling flange 13 is removably coupled to a tip end part 12*a* of the final-stage movable boom 12 of the boom 5. Additionally, the coupling flange 13 is capable of turning about a vertical coupling pin 15 in relation to the tip end part 12*a* of the movable boom 12, from a side surface 5*a* of the boom 5 to a position where the coupling flange faces toward the tip end surface.

In unloading work involving use of the fly jib 6, etc., the fly jib 6 and the coupling flange 13 are caused to turn outward to the side from the side surface 5*a* of the boom 5 about the vertical coupling pin 15, and a switch is made to a state in which the fly jib 6 protrudes toward the front of the boom from the tip end of the boom 5. In this state, the coupling flange 13 is fixedly coupled by a coupling pin (not shown) to the tip end part 12*a* of the movable boom 12 so as to not turn.

The fly jib 6, as shown in FIG. 2, is provided with a fixed-side jib 21 that can be raised and lowered, the fulcrum being the horizontal coupling pin 14 of the coupling flange 13 attached to the tip end part 12*a* of the movable boom 12, and a movable-side jib 22 mounted to the jib 21 so as to be able to protrude from the tip end of the jib 21. Additionally, a jib raising/lowering device 23 and a jib extending/retracting device 24 are disposed on the fly jib 6. The fly jib 6 can raised and lowered by the jib raising/lowering device 23 in relation to the boom 5, from an initial orientation of extending in the length direction and an inclined orientation of being inclined downward at a predetermined angle. The movable-side jib 22 of the fly jib 6 can be extended by the jib extending/retracting device 24 from a stored position of having withdrawn into the fixed-side jib 21 to an extended position shown by the solid lines.

(Control System)

Figure 3:
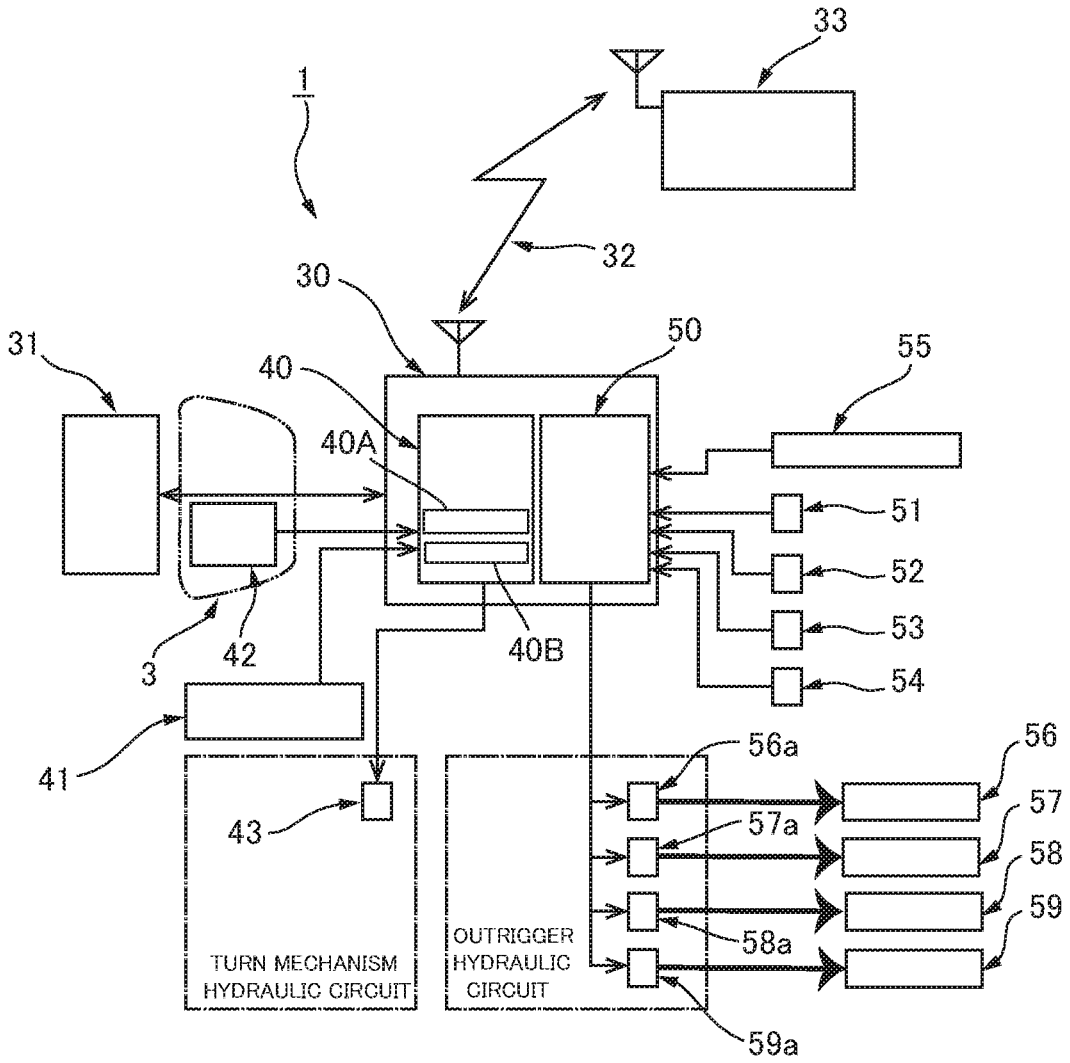
FIG. 3 is a schematic block diagram showing the control system of the crawler crane.

FIG. 3 is a schematic block diagram showing a control system for the crawler crane 1. As shown in this diagram, the control system for the crawler crane 1 is configured around a controller 30 provided with a microcomputer. The controller 30 is commonly configured from a main controller (not shown) installed in the lower traveling body 2 and a turning-body-side controller (not shown) disposed in the upper turning body 4, and communication wires or the like between these controllers are connected via a slip ring.

An operation panel 31 disposed in the front-surface section of the driver seat 3 is connected to the controller 30, and this operation panel can be operated by an operator (not shown) sitting in the driver seat 3. In the present example, a remote operation unit 33 can be connected to the controller 30 via a wireless communication line 32. When the power source of the remote operation unit 33 is switched on, a two-way connection is established via the wireless communication line 32, an operation mode of the controller 30 switches to remote operation mode, and the crawler crane 1 can be operated by remote operation.

The controller 30 is provided with, as mechanisms for ensuring the safety of the crawler crane 1, a boom turn restriction control unit 40 and an outrigger extraction control unit 50, in addition to an overload prevention control unit and other components. These control units are described below.

(Boom Turn Restriction Control Unit)

Figure 4:
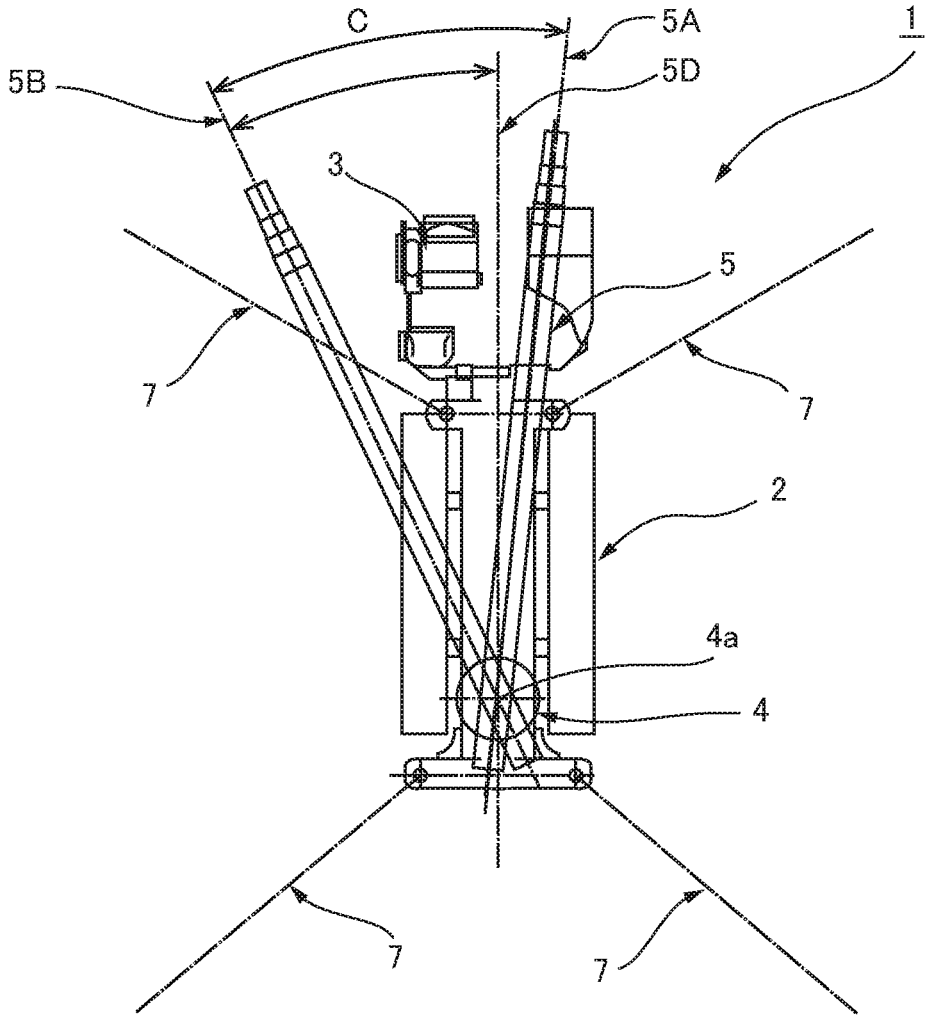
FIG. 4 is an explanatory drawing showing a turn restriction range of a boom.

FIG. 4 is an explanatory drawing showing a boom turn restriction range. The boom turn restriction control unit 40 shall be described with reference to FIGS. 3 and 4.

The boom turn restriction control unit 40 is provided with a turn-restricting unit 40A and a restriction-canceling unit 40B. The turn restriction unit 40A detects the turning angle of the upper turning body 4 on the basis of the output of a turn angle detection potentiometer 41 provided to the upper turning body 4, and automatically performs turn restriction so that the boom 5 does not turn through positions in a predetermined angular range including a preset position directly above the driver seat 3. The supply of actuating hydraulic pressure to the turning mechanism of the upper turning body 4 is controlled by switching a hydraulic valve 43 of a hydraulic circuit of the turning mechanism, and boom turn restriction control is performed. Other detectors can be used to detect the turning angle of the upper turning body 4. For example, a predetermined turning angle position can be detected using a mechanical switch.

In FIG. 4, the stored position of the boom 5 is denoted as 5A. The boom 5 can, for example, turn clockwise about a turning axis 4*a* of the upper turning body 4 to a turn position 5B of 330° (see FIG. 4). Additionally, for example, the range from a stored position 5A counterclockwise to an angle position by 30° is set to a boom turn restriction range C.

The restriction-canceling unit 40B of the boom turn restriction control unit 40 cancels the boom turn restriction control performed by the turn restriction unit 40A when a preset condition is fulfilled. For example, when an operator is not in the driver seat 3, the restriction-canceling unit 40B cancels boom turn restriction. In the present example, boom turn restriction is canceled on the basis of the output of the seating switch 42 (operator detector), which is a mechanical switch disposed in the seat surface of the driver seat 3.

Specifically, when the output of the turn angle detection potentiometer 41 reaches a value that indicates the turn position 5B (see FIG. 4) defining the boom turn restriction range C while the output of the seating switch 42 is on, the turn restriction unit 40A automatically switches the hydraulic valve 43 and forcibly stops the turning of the boom 5.

Additionally, the turn restriction unit 40A invalidates operations that instruct the boom 5 to turn into the boom turn restriction range C.

When the output of the seating switch 42 is off, the restriction-canceling unit 40B cancels (invalidates) the boom turn restriction control performed by the turn-restricting unit 40A and enables the boom 5 to turn into the boom turn restriction range C. The boom is able to turn within a range that reaches from the stored position 5A, past the turn position 5B, to an angle position short of the stored position 5A, e.g., a turn position 5D that is 5° short (see FIG. 4).

Even when the remote operation unit 33 is on and switched to remote operation mode, the restriction-canceling unit 40B cancels the boom turn restriction control if the seating switch 42 is off. It is thereby possible in remote operation mode for the boom 5 to be turned in the range from the stored position 5A to the turn position 5D (a range of substantially 360°).

The presence of an operator in the driver seat 3 may also be detected using another detector such as a pressure sensor. The operator can also be detected using a non-contact sensor such as an optical motion sensor. A motion sensor can be placed in the seat surface of the driver seat 3, the left and right armrests, a position near the driver seat 3, etc. Furthermore, an operator in the driver seat 3 may be detected using an image acquisition and analysis unit. For example, a camera is placed in an area such as the operation panel 31 of the driver seat 3, an image of the driver seat 3 is acquired by the camera, and an operator in the driver seat 3 is detected by analyzing the image.

(Example of Canceling Boom Turn Restriction Control Using Safety Lever)

In this embodiment, the controller 30 may be designed to be capable of detecting whether or not boom turn restriction control is necessary, using a manually operated safety lever placed near the driver seat 3.

Figure 5A:
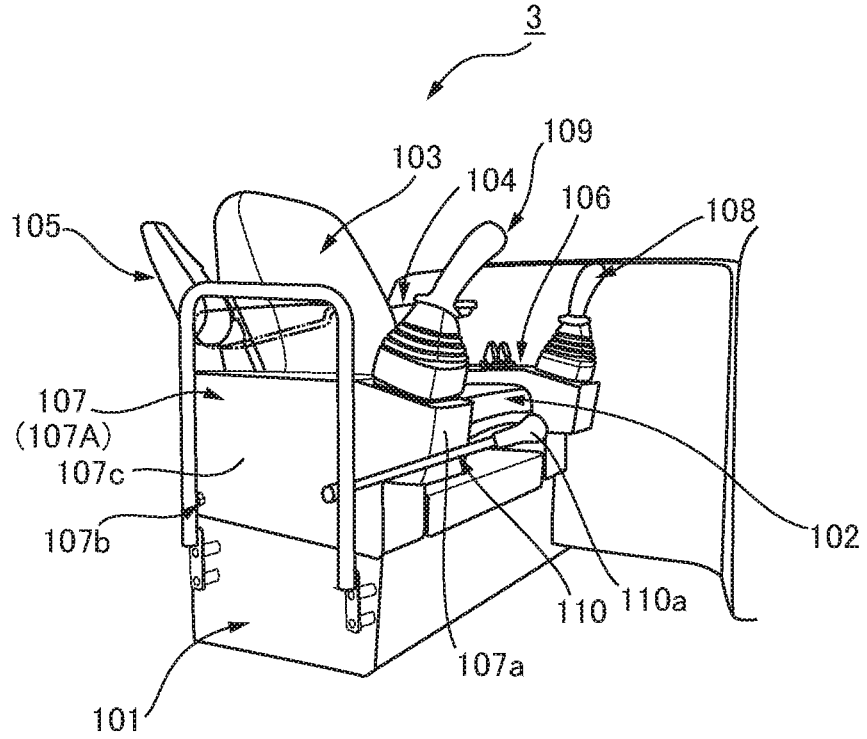
FIG. 5A is an explanatory drawing showing an example of a driver seat provided with a safety lever
Figure 5B:
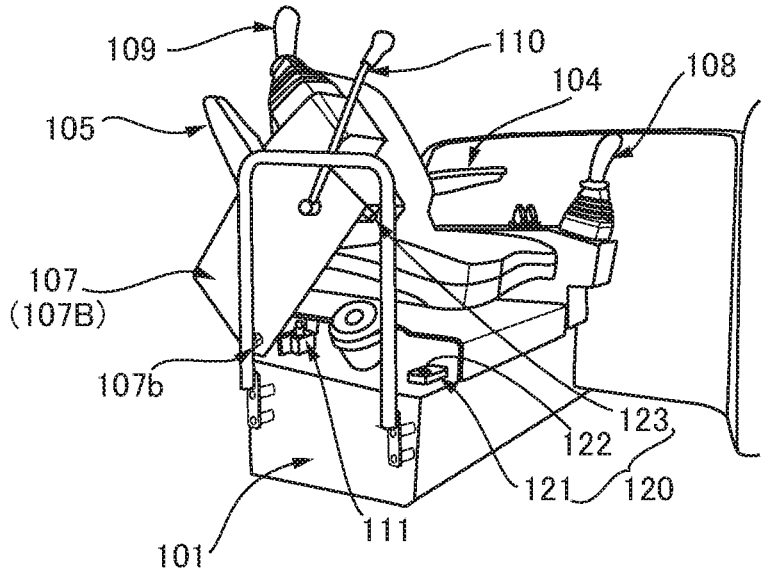
FIG. 5B is an explanatory drawing showing a console in a raised state.
Figure 5C:
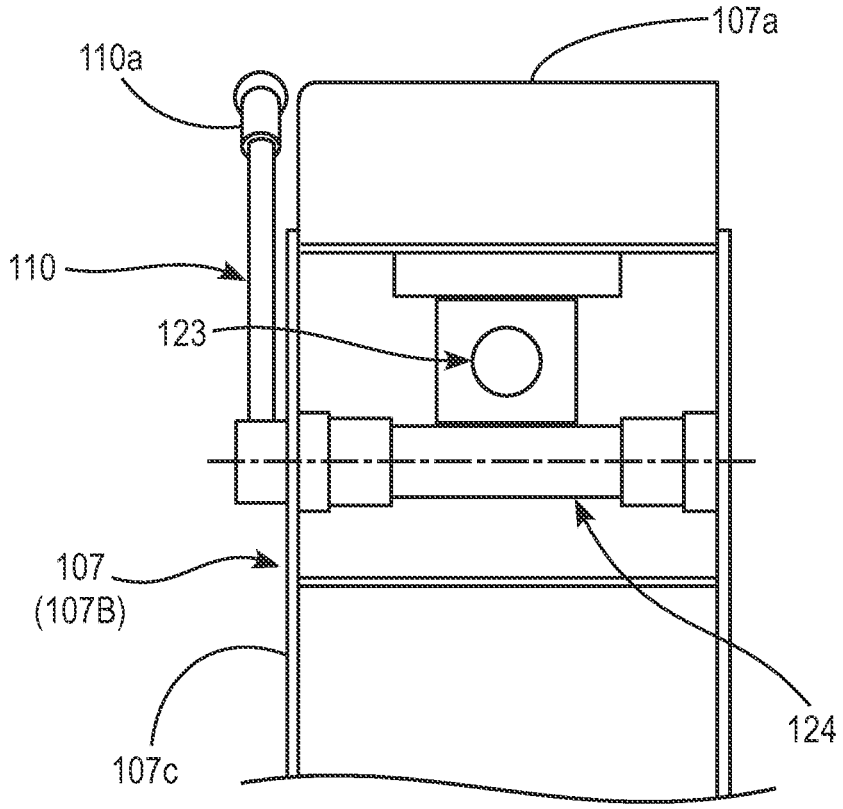
FIG. 5C is an explanatory drawing showing a portion of the console on the same side as a lock pin of a lock mechanism.
Figure 5D:
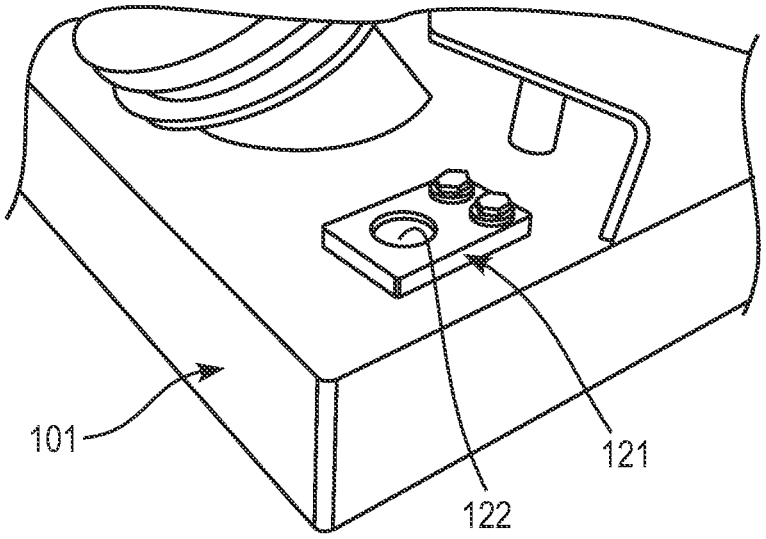
FIG. 5D is an explanatory drawing showing a portion of the console on the same side as a lock hole of the lock mechanism.

FIG. 5A is an explanatory drawing showing an example of a driver seat 3 provided with a safety lever, and FIG. 5B is an explanatory drawing showing a console in a raised state. FIG. 5C is an explanatory drawing showing a portion of the console on the same side as a lock pin of a lock mechanism, and FIG. 5D is an explanatory drawing showing a portion of the console on the same side as a lock hole of the lock mechanism.

The driver seat 3 is attached to, for example, the upper surface of a cuboid-shaped driver seat base 101, as shown in FIG. 5A. The driver seat 3 is provided with a seat surface 102, a backrest 103 extending upward from the rear end of the seat surface 102, and left and right armrests 104, 105 extending forward from the left and right sections of the backrest 103. At least one armrest 105 is designed to be capable of pivoting from the position shown in imaginary lines to a retracted position shown in solid lines.

The operation panel 31 (see FIG. 3) is placed in front of the driver seat 3. Consoles 106, 107, which are left and right side operating parts, are placed to the left and right of the seat surface 102 of the driver seat 3, underneath the armrests 104, 105. Joysticks 108, 109, which are manual operation members, are placed in the front-end sections of the upper-surface portions of the consoles 106, 107, respectively. Various operation members are also placed in the upper-surface portions of the consoles 106, 107. By operating the joysticks 108, 109 and other operation members, it is possible to operate, for example, the upper turning body 4, the crane apparatus, and other components of the crawler crane 1.

One console 106 is fixed to the driver seat base 101. The other console 107 is attached to the driver seat base 101, in such a manner as to be capable of vertically pivoting about a rear end 107*b* of the console. The console 107 is capable of pivoting from an operating position 107A shown in FIG. 5A to a retracted position 107B shown in FIG. 5B. The console 107 is also locked by a lock mechanism 120 into the operating position 107A, which is positioned beneath the armrest 105.

The lock mechanism 120 is provided with a lock hole 122 formed in a fixed-side member 121 attached to the upper-surface portion of the driver seat base 101, and a lock pin 123 attached to the interior of the console 107, as shown in FIGS. 5B, 5C, and 5D. In a locked state, the lock pin 123 is inserted into the lock hole 122 and secured to the fixed-side member 121 side by a predetermined urging force.

An operator sitting in the driver seat 3 is able to operate the joystick 109 or another operation member of the console 107 in the operating position 107A. The joystick 109 or another operation member protruding upward from the upper-surface portion of the console 107 is likely to be a hindrance to getting on and off the driver seat 3. When the console 107 is pivoted to the retracted position 107B, the console is not a hindrance to getting on an off the driver seat 3 from the side, and it is easy to get on and off the driver seat 3.

A safety lever 110 is attached to the console 107. The rear end of the safety lever 110 is attached in a vertically pivotable manner to a side surface 107*c* on the outer side of the console 107. The safety lever 110 extends forward in relation to the driver seat, and a grip 110*a* at the tip end of the safety lever protrudes forward from a front end surface 107*a* of the console 107. The safety lever 110 is held by a predetermined urging force in the position shown in FIG. 5A. From this position, the safety lever 110 can be operated in an upwardly pivoting direction.

Incorporated inside the console 107 is a link mechanism 124 linked to a pivoting shaft of the safety lever 110, as shown in FIG. 5C. The link mechanism 124 converts the upward pivoting of the safety lever 110 to a movement that causes the lock pin 123 to retract against the urging force in a direction away from the lock hole 122.

In the state shown in FIG. 5A, when the safety lever 110 is pulled (pivoted) upward, the lock pin 123 separates from the lock hole 122 and the console 107 is unlocked. When the safety lever 110 is further pulled up, the console 107 is raised up as well, and the console can be raised from the operating position 107A shown in FIG. 5A to the retracted position 107B shown in FIG. 5B.

When the safety lever 110 is lowered forward and downward while the console 107 shown in FIG. 5B is in the retracted position 107B, the console 107 moves as well and returns to the operating position 107A of FIG. 5A. When the console 107 returns to the operating position 107A, the lock pin 123 fits into the lock hole 122 and the console 107 reverts to being locked in the operating position 107A.

A detector for detecting whether or not the console 107 is locked is placed in the upper surface portion of the driver seat base 101 to which the console 107 is attached. For example, a limit switch 111 is placed as a detector as shown in FIG. 5B. When the console 107 is in the operating position 107A, an engaging part (not shown) provided to the console 107 engages with a lever of the limit switch 111, and the lever is pushed down. When the console 107 moves to the retracted position 107B of FIG. 5B, the lever of the limit switch 111 separates from the engaging part.

On the basis of the output of the limit switch 111, the controller 30 can sense that the console 107 is positioned in the operating position 107A (that the console 107 is locked). When an operator is in the driver seat 3, the console 107 is positioned and locked in the operating position 107A, and the controller 30 is therefore able to sense, from the output of the limit switch 111, that the operator is in the driver seat 3. Therefore, when the operator is in the driver seat 3, boom turn restriction control can be performed.

The safety lever 110 can also be placed in, for example, a position separate from the console 107. Additionally, safety can be increased using the safety lever 110 together with the previously-described sitting sensor or another operator detector. Furthermore, a manually operated restriction-canceling lever for canceling boom turn restriction control can be placed separate from the lever for unlocking the console 107. In this case, the restriction-canceling lever can be operated to a restricting position and a restriction-canceling position, and the controller 30 assesses, on the basis of the operating position of the restriction-canceling lever, whether or not to perform boom turn restriction control.

(Outrigger Extraction Control Unit)

Figure 6:
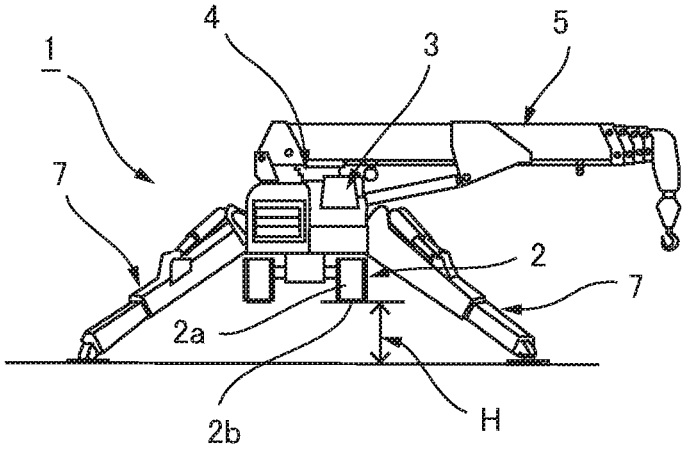
FIG. 6 is an explanatory drawing showing the crawler crane in a raised state due to the extraction of the outriggers.

FIG. 6 is an explanatory drawing showing the crawler crane 1 in a raised state due to the extraction of the outriggers. The outrigger extraction control unit 50 is described with reference to FIGS. 3 and 6.

In the outrigger extracting action, the outrigger extraction control unit 50 detects the grounded state of the outriggers 7 on the basis of the output of grounding detectors 51 to 54 placed on each of the four outriggers 7. Various publicly known mechanisms can be used as grounding detection mechanisms. Additionally, the orientation of the lower traveling body 2 is detected on the basis of output from a vehicle body inclination detector 55 attached to the lower traveling body 2. Various publicly known mechanisms can also be used as the inclination detection mechanism. Outrigger extraction control is performed by switching hydraulic valves 56*a* to 59*a* of a hydraulic circuit for extending and retracting OR cylinders 56 to 59 attached to each of the outriggers 7, and controlling the supply of actuating hydraulic pressure supplied via these valves.

In the extraction action of each of the outriggers 7, first, the outriggers 7 are extracted at an outward incline about the vertical turning axis. The outriggers 7 are then lowered toward the ground by the hydraulic cylinders 7*a* (see FIG. 2). Next, the OR cylinders 56 to 59 are actuated to extend the outriggers 7 until the grounding detectors 51 to 54 of the four outriggers 7 turn on.

After the grounding detectors 51 to 54 have switched to being on, the four OR cylinders 56 to 59 are actuated at a fixed speed for a fixed amount of time, to simultaneously extend the outriggers 7 by a fixed amount. Due to this action, the crawler crane 1 rises up by a predetermined amount, and a gap H of a defined size is formed between the ground and a bottom surface 2*b* of the crawler belt 2*a* (see FIG. 6). To form a gap H of a defined size, non-contact sensors or contact sensors for gap measurement can be placed, and the gap H can be formed on the basis of the outputs of these sensors.

Then, on the basis of the output of the vehicle body inclination detector 55, the four OR cylinders 56 to 59 are individually actuated to individually extend and retract the outriggers 7 so that the lower traveling body 2 achieves a horizontal orientation. The crawler crane 1 thereby comes to be set in place by the outriggers 7 (the lower traveling body 2 comes to be raised up by a gap H of a defined size and held in a horizontal orientation).

The invention claimed is:

1. A mobile crane comprising:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancelation condition is fulfilled; and an operator detection unit that detects whether an operator is in the driver seat, wherein the restriction-canceling condition is in a case in which an operator is not detected by the operator detection unit.

2. The mobile crane according to claim 1, wherein the operator detection unit is any one of:

a sitting switch, a non-contact motion sensor placed in the driver seat or in proximity to the driver seat, and an image acquisition and analysis unit for acquiring an image of the driver seat and assessing presence or absence of an operator from the image.

3. The mobile crane according to claim 1, wherein the lower traveling body is a crawler-type traveling body.

4. A mobile crane comprising:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancelation condition is fulfilled; and a remote operation unit for operating the lower traveling body and the crane apparatus by remote operation, wherein the restriction-canceling condition is in a case in which an operation mode for the lower traveling body and the crane apparatus is a remote operation mode by the remote operation unit.

5. A mobile crane comprising:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancelation condition is fulfilled; and an operator detection unit that detects whether an operator is in the driver seat; and a remote operation unit for operating the lower traveling body and the crane apparatus by remote operation, wherein the restriction-canceling condition is in a case in which an operator is not in the driver seat and at the same time an operation mode for the lower traveling body and the crane apparatus is a remote operation mode by the remote operation unit.

6. A mobile crane comprising:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancelation condition is fulfilled; and a console placed on a side position of the driver seat, the console being movable from an operating position to a retracted position;

a safety lever attached to the console;

a lock mechanism that locks the console in the operating position and unlocks the console in coordination with an operation of the safety lever; and a detection unit for detecting whether the console is locked in the operating position or not, wherein the restriction-canceling condition is in a case in which the console is unlocked.

7. A mobile crane comprising:

a lower traveling body;

a driver seat placed in the lower traveling body;

a crane apparatus installed in the lower traveling body so as to be capable of turning about a turn axis and so as to be capable of rising and falling;

a turn-restricting unit that, based on a turn position of a boom of the crane apparatus, performs boom turn restriction control to prevent the boom from turning within a predetermined angular range above the driver seat, the turn position being centered about the turn axis; and a restriction-canceling unit that cancels the boom turn restriction control when a preset restriction cancelation condition is fulfilled; and a plurality of outriggers attached to the lower traveling body; and an outrigger extraction control unit, wherein the outrigger extraction control unit controls an amount of extraction of each of the outriggers so that a gap reaches a preset defined size, the gap being one between a bottom surface of the lower traveling body and a ground surface where the lower traveling body is positioned; and further comprising:

a grounding detector for detecting a grounded state of each of the outriggers; and a vehicle body tilt detector for detecting a tilted state of the lower traveling body, wherein the outrigger extraction control unit comprises:

a grounding function that causes extending actions for each of the outriggers to be performed until each of the grounding detectors detects a grounded state;

a vehicle body raising function that causes the gap to reach the defined size by extending each of the outriggers simultaneously at a fixed speed for a fixed amount of time; and a horizontal aligning function that, based on the output of the vehicle body tilt detector, individually extends each of the outriggers so that the lower traveling body comes to be in a horizontal orientation.

8. The mobile crane according to claim 7, wherein the lower traveling body is a crawler-type traveling body, and the gap is a distance between the ground and a bottom surface of a crawler belt of the lower traveling body.

* * * * *